United States Patent [19]

Hoffman

[11] 4,284,184

[45] Aug. 18, 1981

[54] COIN MECHANISM TO MERCHANDISING MACHINE INTERFACE

[75] Inventor: David Hoffman, Hillsdale, N.J.

[73] Assignee: Rowe International, Inc., Whippany, N.J.

[21] Appl. No.: 98,772

[22] Filed: Dec. 3, 1979

[51] Int. Cl.[3] ..... G07F 11/00

[52] U.S. Cl. ..... 194/2; 194/10; 194/1 N; 221/129

[58] Field of Search ..... 194/1 R, 1 Z, 1 N, 10, 194/DIG. 3; 221/129

[56] References Cited

U.S. PATENT DOCUMENTS

| | | | |
|---|---|---|---|
| 3,147,838 | 9/1964 | Mueller et al. | 194/10 |
| 3,367,467 | 2/1968 | Ptacek | 194/10 |
| 3,451,518 | 6/1969 | Schneider | 194/2 |
| 3,504,778 | 4/1970 | Ptacek et al. | 194/10 |
| 4,034,839 | 7/1977 | Lee | 194/10 |

*Primary Examiner*—Joseph J. Rolla

*Attorney, Agent, or Firm*—Shenier & O'Connor

[57] ABSTRACT

An interface between a merchandising machine which requires a voltage of a first magnitude for its operation and a coin mechanism which operates at a voltage of a second magnitude in which each selection of the machine is provided with a customer-operated double-pole switch, one pole of which is connected to the coin mechanism to complete the circuit of a relay through the second magnitude voltage source if a sum in money aggregating the purchase price of the article corresponding to the operated switch has been deposited. Completion of the relay circuit closes a switch to complete a circuit from the first magnitude voltage source to the selected unit operating element through the other pole of the operated double-pole switch.

8 Claims, 5 Drawing Figures

Fig 2
PRIOR ART
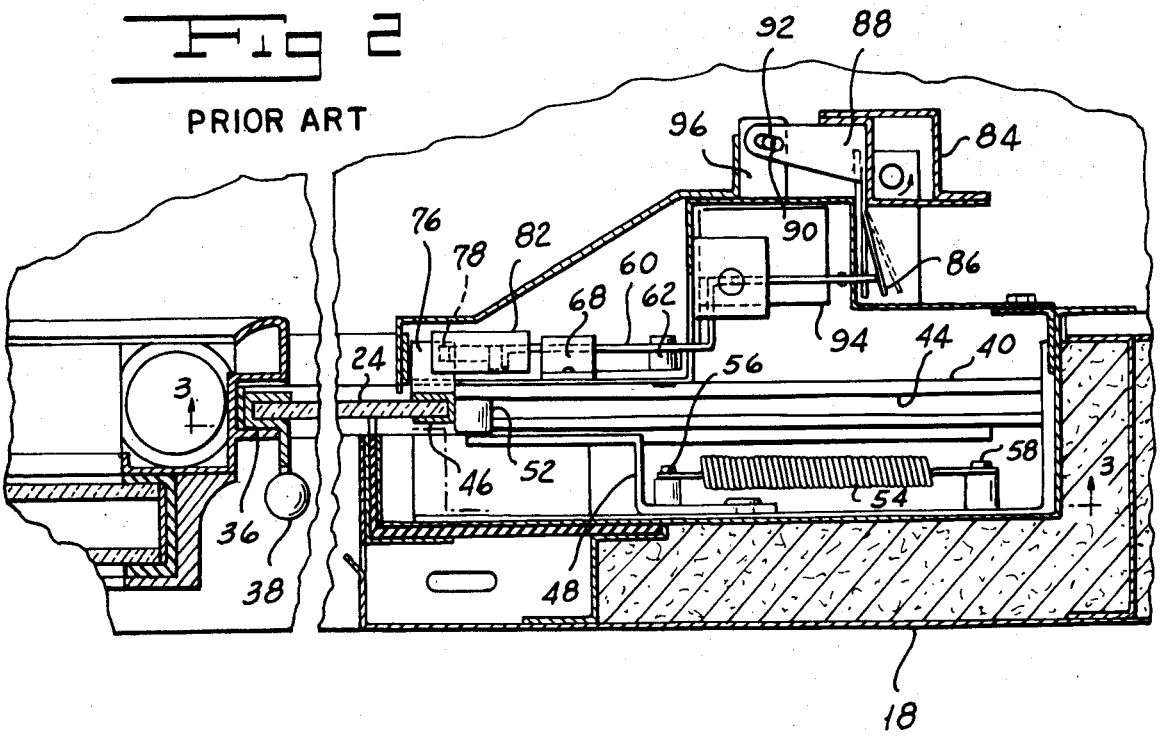
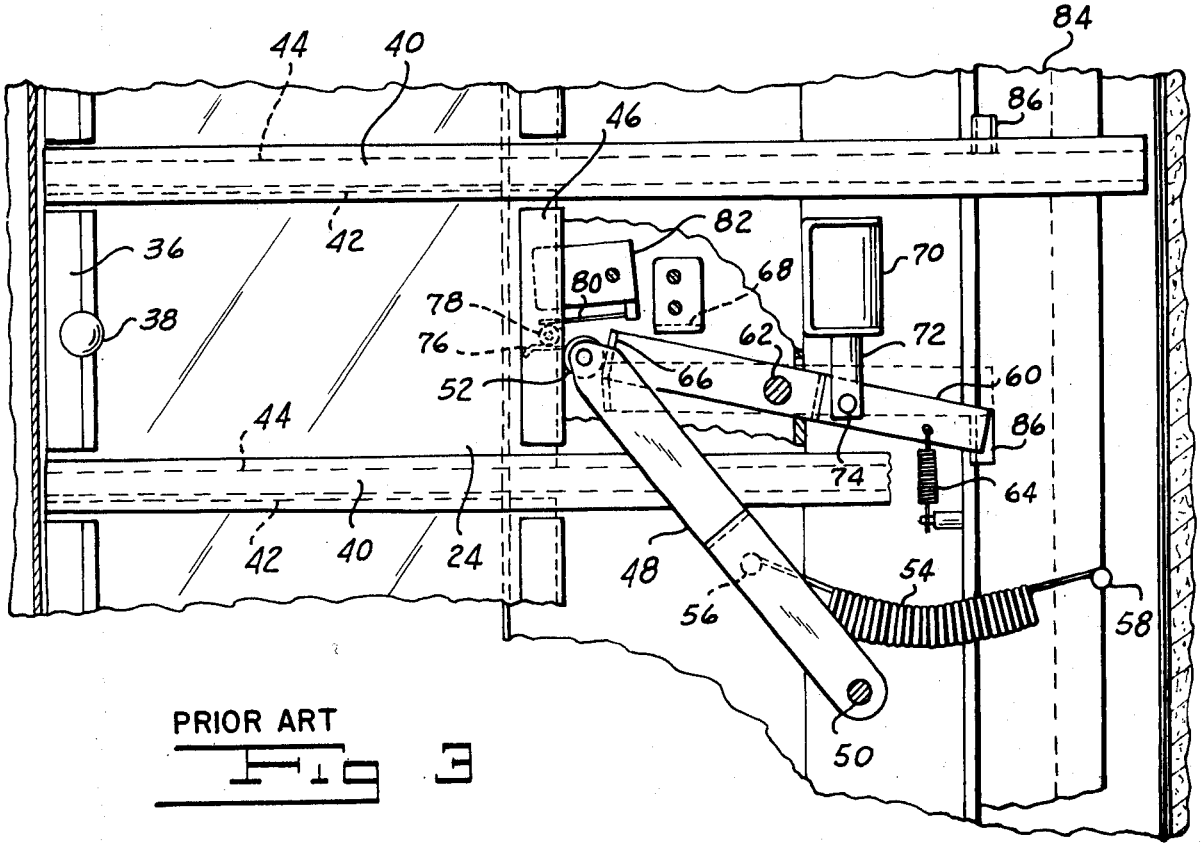
PRIOR ART
Fig 3

COIN MECHANISM TO MERCHANDISING MACHINE INTERFACE

BACKGROUND OF THE INVENTION

Electrically operated merchandising machines for delivering various articles at different prices have long been known in the prior art. An integral part of each of these machines is the coin mechanism which permits delivery of a particular article when a sum in money aggregating at least the purchase price of that article has been accepted by the coin mechanism.

Initially, all merchandising machines were designed to operate on standard line voltage of, for example, 120 volts. The coin mechanisms which were used with these machines, likewise, were designed to operate on 120 volts. In recent times, however, merchandising machines have been designed to operate at a reduced voltage of, for example, 24 volts. Correspondingly, the more recently developed coin mechanisms have been designed to operate at 24 volts. These later developed coin mechanisms moreover, have been designed to accommodate a much wider range of prices and a greater number of selections that are provided by the older coin mechanisms operating on 120 volts.

It is, of course, desirable that the newer 24 volt coin mechanisms be able to be used with merchandising machines designed to operate at 120 volts. Interfaces have been designed to permit the 24 volt coin mechanism to be used in conjunction with a 120 volt machine. In general, these interfaces are complicated and consequently expensive. For example, in one specific instance, the interface circuitry between the merchandising machine shown in U.S. Pat. No. 3,147,838, with the 24 volt coin mechanism shown in U.S. Pat. No. 4,034,839, has involved as many as seventeen relays and numerous resistors, capacitors and diodes.

SUMMARY OF THE INVENTION

One object of my invention is to provide a coin mechanism to merchandising machine interface which is simpler than are interfaces of the prior art.

Another object of my invention is to provide an interface which matches a coin mechanism operating at a voltage of one magnitude to a merchandising machine which operates at a voltage of a different magnitude.

Yet another object of my invention is to provide a coin mechanism to merchandising machine interface which is less expensive than are interfaces of the prior art.

Still another object of my invention is to provide a coin mechanism to merchandising machine interface which is highly reliable.

Other and further objects of my invention will appear from the following description.

In general my invention contemplates the provision of an interface between a merchandising machine which requires a voltage of a first magnitude for its operation and a coin mechanism which operates at a voltage of a second magnitude in which each selection of the machine is provided with a customer-operated double-pole switch, one pole of which is connected to the coin mechanism to complete the circuit of a relay through the second magnitude voltage source if a sum in money aggregating the purchase price of the article corresponding to the operated switch has been deposited. Completion of the relay circuit closes a switch to complete a circuit from the first magnitude voltage source to the selected unit operating element through the other pole of the operated double-pole switch.

BRIEF DESCRIPTION OF THE DRAWINGS

In the accompanying drawings to which reference is made in the instant specification and in which like reference characters are used to indicate like parts in the various views:

FIG. 2 is a fragmentary sectional view of the merchandising machine shown in FIG. 1 taken along the line 2—2 of FIG. 1.

FIG. 3 is a sectional view of the portion of the merchandising machine illustrated in FIG. 2 with parts broken away and taken along the line 3—3 of FIG. 2.

DESCRIPTION OF THE PREFERRED EMBODIMENT

Figure 1:
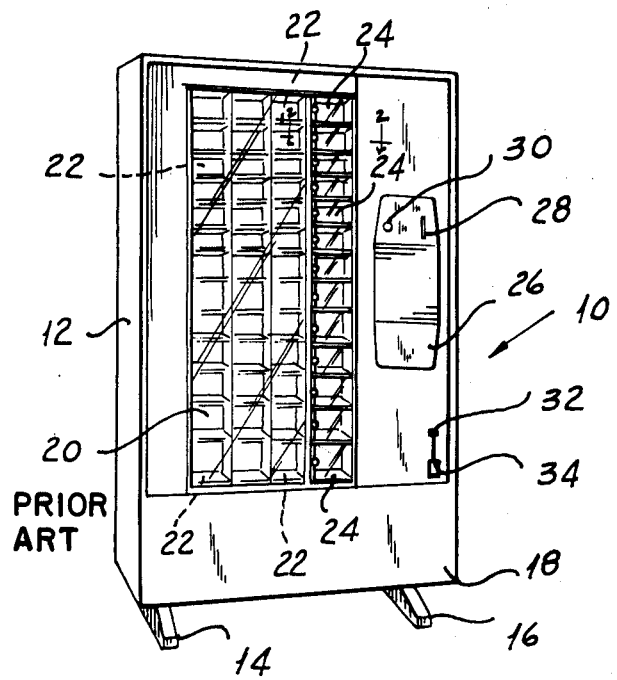
FIG. 1 is a perspective view of one form of merchandising machine with which my coin mechanism to merchandising machine interface may be used.

Referring now to FIGS. 1 to 3 of the drawings, one form of merchandising machine indicated generally by the reference character 10 with which my interface can be employed includes a cabinet 12 having feet 14 and 16. The cabinet door 18 is provided with a window 20 through which merchandise carrier compartments 22 can be viewed by the prospective customer. An access door 24 is associated with each row of compartments 22. The door 18 carries an information panel 26 provided with suitable legends, a coin slot 28, and a push-button 30 for driving the merchandise compartment carriers in a manner to be described. A coin return actuator may be operated to cause money to be returned to the customer through a slot 34 in the event a purchase is not made.

Each compartment access door 24 has a handle support 36 along one edge thereof which carries a handle 38 which permits the door to be moved from left to right as viewed in FIGS. 2 and 3 in a manner to be described. Each of a plurality of laterally extending tracks 40 is formed with an upper way 42 which supports the lower edge of one door and with a lower way 42 which receives the upper edge of a door 24. Each of the doors 24 is provided with a bearing plate 46 along its edge remote from the edge carrying the handle support 36. A crank arm 48 pivotally supported on a pin 50 carries a roller 52 which bears against the plate 46. A spring 54 extending between a pin 56 on the crank arm 48 and the pin 58 on the machine frame normally urges the roller 52 into engagement with the plate 46. It will readily be apparent that there are as many arms 48 and associated elements as there are doors 24.

Each of the selecting units of the machine 10 includes a locking lever 60 pivotally supported on a pin 62. A spring 64 normaly urges the lever 60 to a position at which a stop 66 thereon is to the right of or behind the roller of the associated door 24. A stop 68 secured to the machine frame limits the movement of the lever 60 under the action of spring 64 to this position. A solenoid 70 is adapted to be energized to move its armature 72 upwardly to cause a pin which connects the armature to lever 60 to pivot the lever in a counterclockwise direction as viewed in FIG. 3 to the broken line position. In the fully closed position of a door 24 a cam 76 on plate 46 acts on a follower 78 carried by a switch actuating arm 80 of a switch 82 normally to hold the switch poles in one position. The relative disposition of all of the parts is such that a door 24 can be moved towards its open position a sufficient distance to cause follower to move along cam 76 downwardly through a sufficient distance to change the condition of the switch while the lever 60 is in the full line position illustrated in FIG. 3. However, the door cannot be fully opened unless the lever 60 has been moved to its broken line position.

As will be more fully apparent from the description hereinbelow with a compartment 22 carrying a desired article behind its associated door 24 and after a sum in money aggregating at least the purchase price of the article has been deposited in the coin mechanism to be described, the customer may move the door 24 to the right a sufficient distance to change the positions of the poles of switch 82 to connect solenoid 70 to a source of voltage of a first magnitude to operate the solenoid to move the lever 60 to the broken line position. In this position of the parts the door can be fully opened.

As the lever 60 moves to the broken line position, one of a number of resilient fingers on a vertically extending lock-up bar 84 springs into position under the end of the lever to hold it in the full line position. With the parts in this relative position the door can be opened and closed until such time as the lock-up bar 84 is pivoted in a counterclockwise direction as viewed in FIG. 2 to move the finger 86 to the broken line position shown therein to release the lever 60 which had been locked. This operation of the lock-up bar takes place upon the energization of a solenoid 94 to move its armature 96 downwardly as viewed in FIG. 2 to cause a pin 92 riding in a slot 90 in a crank arm 88 carried by the bar 84 to rotate the bar to release the locked lever.

Figure 4:
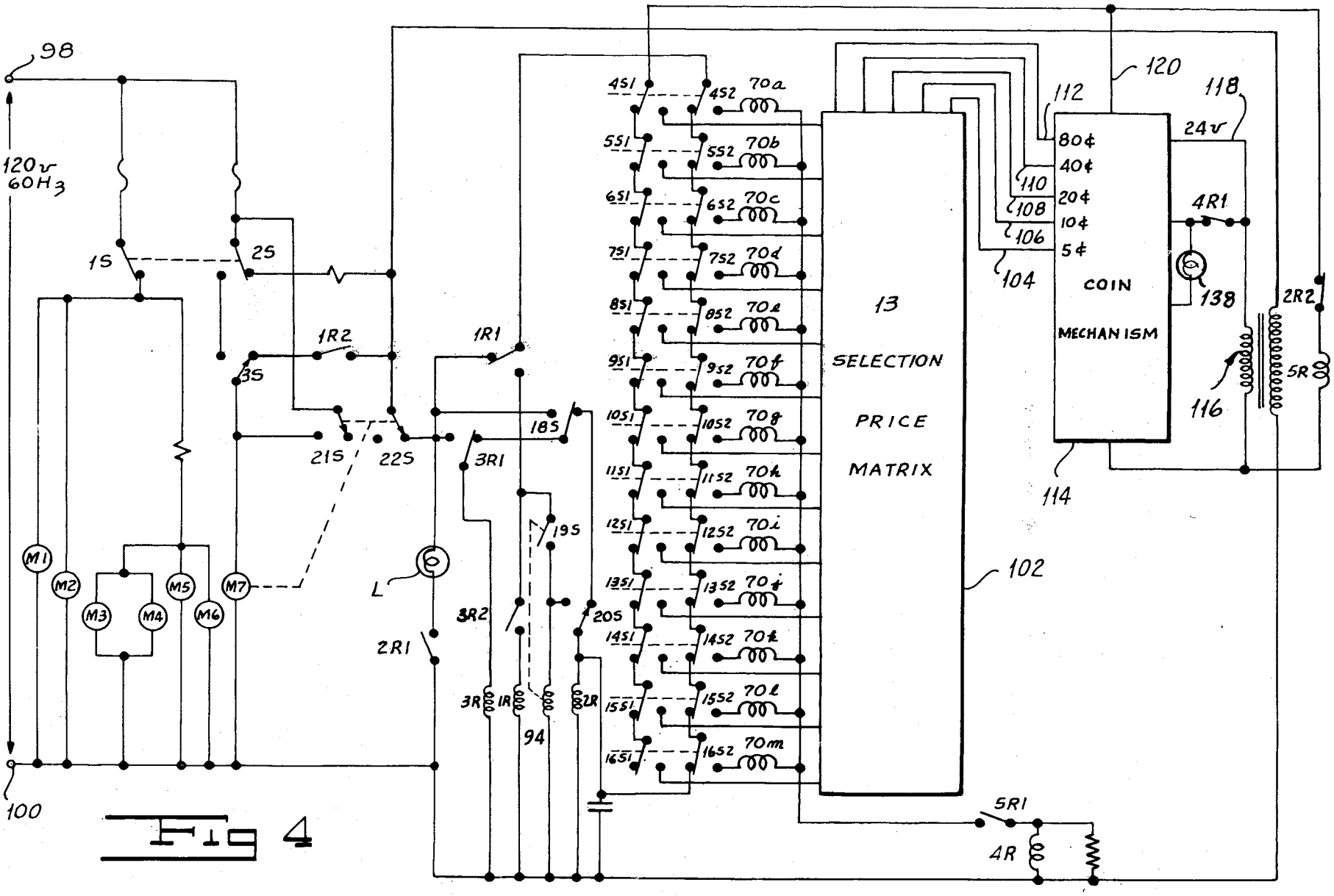
FIG. 4 is a schematic view of the electrical circuitry of the merchandising machine and coin mechanism employing my interface.

Referring to FIG. 4, the electrical circuitry associated with the merchandising 10 includes a source of voltage such for example, as a 120 volt, 60 Hertz source having terminals 98 and 100. A door interlock switch includes ganged arms, one arm 1S of which is adapted to energize evaporator fan motors M1 and M2, condenser fan motors M3 and M4 and compressor motors M5 and M6. The other door interlock switch 2S is adapted to apply power to the power circuit of the machine when the door is closed. When the machine door is open so that switches 1S and 2S occupy positions other than those shown in FIG. 4, a service switch 3S may be operated to energize transport motor M7.

By way of example, in circuits shown in FIG. 4, I have illustrated 13 selection switches associated with the 13 doors 24 of the machine 10. One of these selection switches is identified by the reference character 82 in FIG. 3. In FIG. 4 for purposes of clarity, I have designated the respective selection switches as 4S through 16S. It will be seen that each of these selection switches has a pair of poles designated, for example, as 4S1 and 4S2 for the first selection afforded by the machine. The machine control circuit includes a door open relay winding 2R adapted when energized to open a normally closed switch 2R1 and to close a normally open "enable vend" switch 2R2. In the normal condition of the circuit with power up and with all of the doors closed winding 2R is energized from terminal 98 through switch 2S, a normally closed transport motor full cycle switch 22S, a normally closed transport motor relay switch 1R1, all of the switches 4S2 through 17S2 to the winding 2R and thence to terminal 100. If any door is not fully closed its associated switch such as 4S2 for example, will be in a position other than that illustrated in FIG. 4 so that the circuit to winding 2R is not complete. Under these conditions, switch 2R1 closes to complete the circuit of lamp L to indicate that a door is open at the same time switch 2R2 is open so that no sale can be made.

With all of the doors closed so that power is applied to the upper terminal of winding 2R the circuit to relay winding 3R is complete through transport motor switch 20S through a single revolution transport switch 18S and through switch 3R1 to the winding 3R. Upon its energization winding 3R moves switch 3R1 to a position at which it completes the winding holding circuit. At the same time it readies the transport motor relay circuit by closing switch 3R2.

Under the conditions described above, in order to move the carriers past the doors and to position any carrier behind any particular door the customer actuates button 30 to move switch 20S from the position shown in FIG. 4 to its other position to complete the circuit of lock-up bar solenoid 94 to reset all of the door locking levers 20 and to close a switch 19S to complete the circuit of winding 1R. Energization of winding 1R moves contacts 1R1 from the position shown in FIG. 4 to its other position to hold the circuit of winding 1R through a normally closed switch 22S of the one revolution switch associated with the transport motor M7. At the same time switch 1R2 is closed to energize the transport motor M7. As soon as the motor begins to drive it opens switch 22S to interrupt the holding circuits of winding 3R and 1R and to complete its own holding circuit through a normally open switch 21S. The motor M7 maintains this condition of the two switches 21S and 22S for a single revolution of the motor shaft. At the end of a revolution the compartment carrier stops with one column of compartments precisely in registry with the column of doors 24. The operation of the transport motor will continue so long as the switch 20S is held in the position other than that shown in FIG. 4. When the button 30 is released the motor M7 will complete one revolution and the portions of the circuit thus far described will return to their initial conditions.

I connect one terminal of the solenoid 70 of a selection unit t the normally open contact of the corresponding S2 switch pole and connect the other terminal of the solenoid to a normally open switch 5R1 adapted to be closed to connect the solenoid to terminal 100 through a suitable resistor. Thus referring to FIG. 4 it will be seen that I connect the respective first terminals of solenoids **70*a* through 70*m* to the normally opened switch contacts associated with switch poles 4S2 through 16S2. I connect the respective normally open contacts associated with switch poles 4S1 through 16S1 to a 13 selection price matrix 102. The other inputs to the price matrix 102 are provided by the price lines 104, 106, 108, 110 and 112 of a coin mechanism 114. A step-down transformer indicated generally by the reference character 116 connected across the terminals 98 and 100 puts out 24 volts on a line 116 as an input to the coin mechanism 114. As will be explained more fully hereinbelow, the coin mechanism 114 continually puts out interrogating pulses on a line 120 which is connected to the series connected switch poles 4S1 to 16S1. The vend enable relay switch 2R2 and a vend relay winding 5R are connected in series between line 120 and the lower terminal of the secondary of transformer 116. However, the magnitude of the pulses put out on line 120 is not sufficient to energize winding 5R**.

From the structure just described it will be appreciated that if an attempt is made to open a door so that the corresponding switch pole such as 4S1 for example is in engagement with its normally open contact, the interrogating pulses on line 120 will be applied to the matrix 102. At the same time, a circuit is complete to the normally open contact of the switch pole 4S2 for example, connected to solenoid 70*a*. The other terminal of the solenoid, however, is open. As will be explained more fully hereinbelow, if a price corresponding to the price of any of the price lines 104, 106, 108, 110, and 112, has been deposited in the coin mechanism and if the matrix couples the operated selection switch to that price line then the coin mechanism puts out a signal of 24 volts on line 120 which is sufficient to energize winding 5R to close contacts 5R1 to energize solenoid 70*a* to release the associated door lock. At the same time, winding 4R is energized to open the reset relay contacts 4R1 to reset the coin mechanism.

Figure 5:
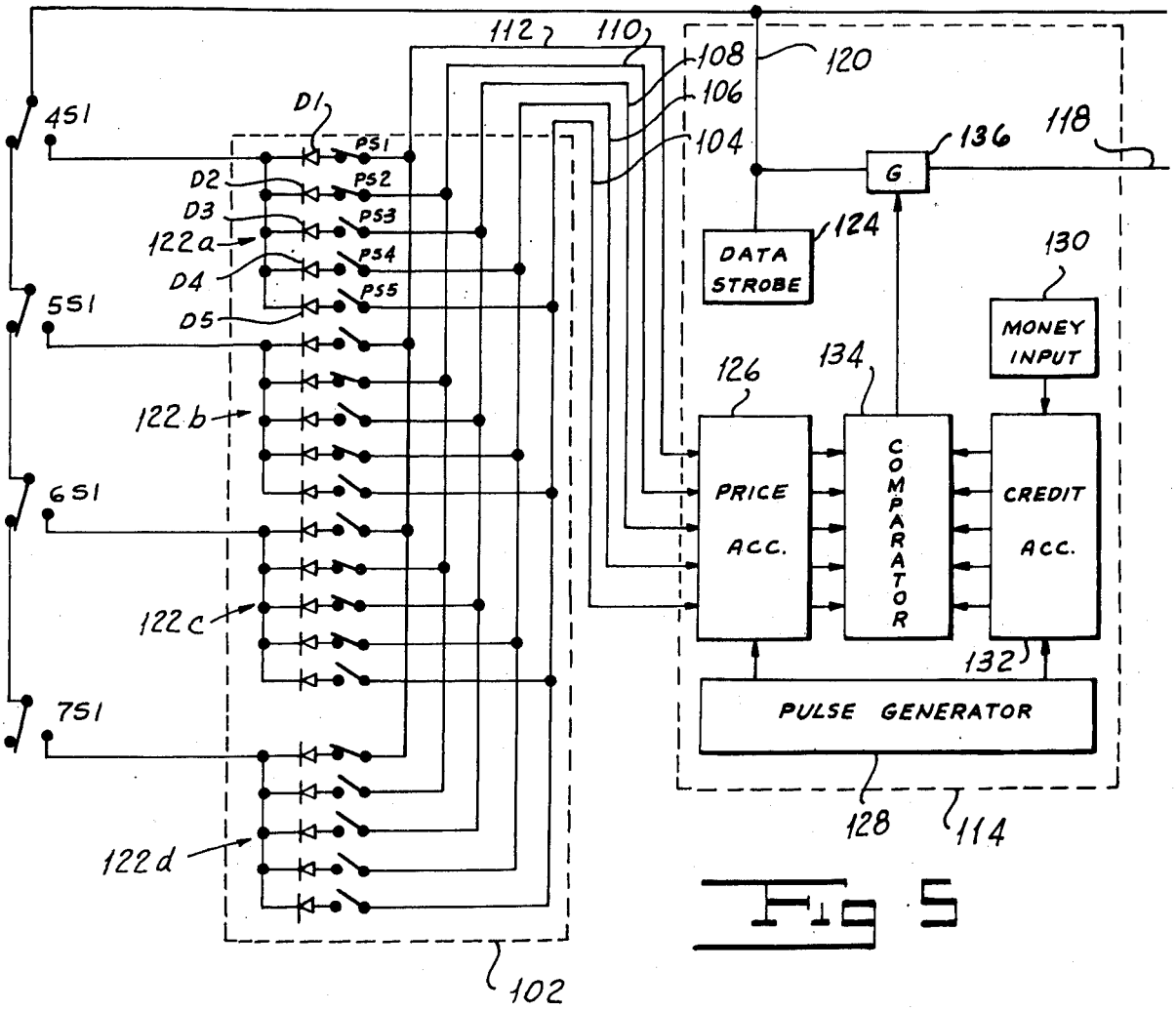
FIG. 5 is a schematic view illustrating some of the details of the coin mechanism and price selection system of the arrangement illustrated in FIG. 4.

Referring now to FIG. 5, there is illustrated in more detail the structure of the price selection matrix 120 and coin mechanism 114.

For purpose of simplicity in FIG. 5, we have shown the circuitry associated with only switches 4S1 through 7S1. The normally open contacts of these switches are connected respectively to price selection switch arrays 122*a* through 122*d* of the price selection matrix 102. Each of the price selection arrays includes a plurality of price selection switches P1 through P5 connected in series with diodes D1 to D5 between the respective price lines 104, 106, 108, 110 and 112 and a common line leading to the normally open contact of the corresponding selection switch such as switch 4S1. The switches PS1 through PS5 of each of the arrays 122*a* through 122*d* are so closed as to set the corresponding selection to sell at a particular price. For example, only switches PS1 and PS2 of array 122*a* are closed so that the article corresponding to selection switch 4S1 sells for a price of $1.20. Only switch PS2 of array 122*b* is closed so that the selection corresponding to switch 5S1 sells for a price of $0.40. Switches PS2 through PS4 of group 122*c* are closed so that the article corresponding to switch 6S1 sells for a price of $0.70. Similarly the article corresponding to switch 7S1 sells at a price of $0.80. It will be understood that an array 122 of price setting switches provided for each of the selections adapted to be delivered by the machine 10.

One form of the coin mechanism 144 which I may employ with my interface is shown and described in U.S. Pat. No. 4,034,839 referred to hereinabove. This coin mechanism as is pointed out hereinabove receives a 24 volt input signal on line 118. The mechanism 114 includes a data strobe 124 which produces a continuous supply of output pulses at a certain frequency such, for example, as the line frequency of 60 cycles. These pulses which are applied to the poles of the 4S1 switches as well as to the winding 5R through switch 2R2 are not sufficiently strong to energize winding 5R.

When anyone of the selection switch poles 4S1 through 16S1 is closed it applies the pulse output on line 120 to its associated price setting switch array to couple the signals to those of the price lines in the circuits of price switches which have been closed. The price lines in turn apply the signals to a price accumulator 126.

A common pulse generator circuit 128 applies pulses to the price accumulator 126 and to the credit accumulator 132 which is set to an amount of credit corresponding to the amount of the money deposited in the money input unit 130 of the coin mechanism 114. When an amount of credit has been stored in the accumulator 132 which is at least equal to the price corresponding to that set for the selection switch operated, a comparator 134 responsive to the price accumulator 126 and to the credit accumulator 132 produces an output pulse which operates a gating circuit 136 to couple the 24 volt signal on line 118 to line 120 to provide a signal of a sufficient magnitude to operate relay 5R to close switch 5R1. Closing of the switch 5R1 completes the circuit of all of the solenoid windings 70*a* through 70*m* so that the solenoid corresponding to the operated switch pole of the plurality of switch poles 4S2 through 4S16 is complete to unlock the corresponding door. At the same time winding 4R is energized to open switch contacts 4R1 to reset the coin mechanism 114. I provide the coin mechanism 114 with a "Use Correct Change" lamp 138 in a manner known to the art.

The operation of my coin mechanism to merchandising machine interface will readily be apparent from the description hereinabove. The coin mechanism 114 operates on 24 volts. The door unlocking solenoids require 120 volts for their operation. When any one of the selecting switches 4S to 16S is operated the S2 pole connects one terminal of the associated solenoid 70 to terminal 98 through switches 1R1, 22S and 2S. The S1 pole of the operated selecting switch applies the datastrobe pulses on line 120 to the selection price matrix 102. If a sum in money at least equal to the purchase price of the article corresponding to the operated selecting switch has been credited in the coin mechanism 114, a 24 volt signal will appear on line 120 to energize vend relay winding 5R to close switch 5R1 to complete the 120 volt circuit from the other terminal of the solenoid 70 corresponding to the actuated selection switch through a resistor to terminal 100. Energization of the solenoid will unlock the door in front of the compartment containing the desired article and the delivery takes place in the usual manner. At the same time reset relay winding 4R is energized to open switch 4R1 to reset the coin mechanism.

It will be seen that I have accomplished the objects of my invention. I have provided an interface which matches a coin mechanism operating at a voltage of one magnitude to a merchandising machine which operates at a voltage of a different magnitude. My interface is less expensive than are interfaces of the prior art for accomplishing the same object. My interface is simpler and more reliable than are interfaces of the prior art for accomplishing the same result.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A merchandising machine control circuit for selectively connecting one of a plurality of energizable elements to a first source of voltage of a first magnitude in response to energization of a relay winding from a second voltage source of a second magnitude including in combination, a coin mechanism having an interrogating signal output and a credit accumulator and a plurality of price lines, a plurality of manually operable selection switches each having a first pole associated with a first normally open contact and with a first normally closed contact and a second pole associated with a second normally open contact and with a second normally closed contact, a selection price matrix selectively connecting said first normally open contacts to said price lines, means for applying said interrogating signal to said first poles, means connecting said second normally open contacts respectively to first terminals of said energizable members and means connecting said second poles to one terminal of said first voltage source, said coin mechanism being responsive to actuation of a selection switch the first normally open contact of which is connected to price lines corresponding to a sum at least equal to the credit stored in said accumulator for applying said second voltage to said relay winding to connect the other terminals of said elements to the other terminal of said first source, said selection switches being connected in series with each of said first normally closed contacts connected to the succeeding first pole and with each of the second normally closed contacts being connected to the succeeding second pole.

2. A merchandising machine control circuit for selectively connecting one of a plurality of energizable elements to a first source of voltage of a first magnitude in response to energization of a relay winding from a second voltage source of a second magnitude including in combination, a coin mechanism having an interrogating signal output and a credit accumulator and a plurality of price lines, a plurality of manually operable selection switches each having a first pole associated with a first normally open contact and with a first normally closed contact and a second pole associated with a second normally open contact and with a second normally closed contact, a selection price matrix selectively connecting said first normally open contacts to said price lines, means for applying said interrogating signal to said first poles, means connecting said second normally open contacts respectively to first terminals of said energizable members and means connecting said second poles to one terminal of said first voltage source, said coin mechanism being responsive to actuation of a selection switch the first normally open contact of which is connected to price lines corresponding to a sum at least equal to the credit stored in said accumulator for applying said second voltage to said relay winding to connect the other terminals of said elements to the other terminal of said first source.

3. A merchandising machine control circuit for selectively connecting one of a plurality of energizable elements to a first source of voltage of a first magnitude in response to energization of a relay winding from a second voltage source of a second magnitude including in combination, a coin mechanism, a credit accumulator and a plurality of manually operable selection switches each having a first pole associated with a first normally open contact and with a first normally closed contact and a second pole associated with a second normally open contact and with a second normally closed contact, means connecting said second normally open contacts respectively to first terminals of said energizable members and means connecting said second poles to one terminal of said first voltage source, means responsive to movement of a first pole into engagement with its normally open contact for applying price information to said coin mechanism, said coin mechanism being responsive to actuation of a selection switch the first normally open contact of which provides price information representing a sum at least equal to the credit stored in said accumulator for applying said second voltage to said relay winding to connect the other terminals of said elements to the other terminal of said first source, said selection switches being connected in series with each of said first normally closed switches connected to the succeeding first pole and with each of the second normally closed contacts being connected to the succeeding second pole.

4. A merchandising machine control circuit for selectively connecting one of a plurality of energizable elements to a first source of a voltage of a first magnitude in response to energization of a relay winding from a second voltage source of a second magnitude including in combination, a coin mechanism having an interrogating signal output and a credit accumulator, a plurality of manually operable switches each having a first pole associated with a first normally open contact and with a first normally closed contact and a second pole associated with a second normally open contact and with a second normally closed contact, means for applying said interrogating signal to said first poles, means connecting said second normally open contacts respectively to first terminals of said energizable members and means connecting said second poles to one terminal of said first voltage source, means responsive to movement of a first pole into engagement with its normally open contact for applying price information to said coin mechanism, said coin mechanism being responsive to actuation of a selection switch the first normally open contact of which provides price information representing a sum at least equal to the credit stored in said accumulator for applying said second voltage to said relay winding to connect the other terminals of said elements to the other terminal of said first source.

5. A merchandising machine control circuit for selectively connecting one of a plurality of energizable elements to a first source of voltage of a first magnitude in response to energization of a relay winding from a second voltage source of a second magnitude including in combination, a coin mechanism having a credit accumulator, a plurality of manually operable selection switches each having a first pole associated with a first normally open contact and with a first normally closed contact and a second pole associated with a second normally open contact and with a second normally closed contact, means connecting said second normally open contacts respectively to first terminals of said energizable members and means connecting said second poles to one terminal of said first voltage source, means responsive to movement of a first pole into engagement with its normally open contact for applying price information to said coin mechanism, said coin mechanism being responsive to actuation of a selection switch the first normally open contact of which provides price information representing a sum at least equal to the credit stored in said accumulator for applying said second voltage to said relay winding to connect the other terminals of said elements to the other terminal of said first source.

6. A merchandising machine control circuit for selectively connecting one of a plurality of energizable elements to a power source in response to energization of a relay winding including in combination, a coin mechanism having a credit accumulator, a plurality of manually operable selection switches each having a first pole associated with a first normally open contact and with a first normally closed contact and a second pole associated with a second normally open contact and with a second normally closed contact, means connecting said second normally open contacts respectively to first terminals of said energizable members and means connecting said second poles to one terminal of said power source, means responsive to movement of a first pole into engagement with its normally open contact for applying price information to said coin mechanism, said coin mechanism being responsive to actuation of a selection switch the first normally open contact of which provides price informatiomn representing a sum at least equal to the credit stored in said accumulator for energizing said relay winding to connect the other terminals of said elements to the other terminal of said power source.

7. In a merchandising machine having an element adapted to be energized from a voltage source of a first magnitude, a control circuit including a voltage source of a second magnitude, a vend relay adapted to be energized in response to said second magnitude voltage, a coin mechanism comprising means for producing an interrogating signal and having a credit accumulator, an externally accessible manually operable switch having a first pole and associated first normally open and normally closed contacts and a second pole and associated second normally open and normally closed contacts, means for applying said interrogating signal to said first pole, means connecting said second pole to one terminal of said first magnitude source, means connecting said second normally open contact to one terminal of said element, means responsive to movement of said pole into engagement with said normally open contact for applying price information to said coin mechanism, said coin mechanism applying said second magnitude voltage to said vend relay when said price information represents a sum at least equal to that stored in said accumulator and means responsive to said vend relay for connecting the other terminal of said element to the other terminal of said first magnitude source.

8. In a merchandising machine having an element adaped to be energized from a voltage source of a first magnitude, a control circuit including a voltage source of a second magnitude, a vend relay adapted to be energized in response to said second magnitude voltage, a coin mechanism comprising means for producing an interrogating signal and having a credit accumulator, an externally accessible manually operable switch having a pole and associated normally open and normally closed contacts, means for applying said interrogating signal to said pole, means responsive to said interrogating signal upon movement of said pole into engagement with said normally open contact for applying price information to said coin mechanism, said coin mechanism applying said second magnitude voltage to said vend relay when said price information represents a sum at least equal to that stored in said accumulator and means responsive to said vend relay for completing the circuit between said element and said first magnitude source.

* * * * *